US005983433A

United States Patent [19]

Chapman

[11] Patent Number: 5,983,433

[45] Date of Patent: Nov. 16, 1999

[54] FOOT CLEANING DEVICE

[76] Inventor: Mark Chapman, 41 Sunset Trail, Denville, N.J. 07834

[21] Appl. No.: 09/045,977

[22] Filed: Mar. 17, 1998

[51] Int. Cl.[6] ..... A46B 11/02

[52] U.S. Cl. ..... 15/104.92; 401/6; 4/622; 4/606

[58] Field of Search ..... 15/104.92; 4/606, 4/622, 615; 401/6

[56] References Cited

U.S. PATENT DOCUMENTS

| | | | |
|---|---|---|---|
| D. 374,505 | 10/1996 | Garrison | D28/63 |
| 3,548,439 | 12/1970 | Berst | 15/104.92 |
| 3,973,286 | 8/1976 | Logan | 15/104.92 |
| 4,617,917 | 10/1986 | Miller | 15/104.92 |
| 4,918,779 | 4/1990 | Burns | 15/104.92 |
| 5,163,200 | 11/1992 | Carlin et al. | 15/104.92 |
| 5,177,829 | 1/1993 | Simpson | 15/104.92 |
| 5,228,165 | 7/1993 | Westberry et al. | 15/160 |

*Primary Examiner*—Mark Spisich
*Assistant Examiner*—Theresa T. Snider
*Attorney, Agent, or Firm*—Goldstein & Canino

[57] ABSTRACT

A foot cleaning device for use by a user in a bathing chamber. The device, which will preferably be situated on the floor or bottom surface of the bathing chamber, includes a reservoir to hold a cleaning fluid that is dispensed when the user steps upon the device. Bristles are provided on wall surfaces of the reservoir, and scrubbing arcs may further be included to assist in cleaning and scrubbing of a foot of the user.

1 Claim, 3 Drawing Sheets

FOOT CLEANING DEVICE

BACKGROUND OF THE INVENTION

1. Field of the Invention

The invention relates to bathing aids designed to assist a user when showering or more generally bathing. More particularly, the present invention relates to a foot cleaning device to scrub and clean a foot of a user while the user maintains a standing position.

2. Background and Objects of the Invention

There are many bathing aids known in the art that assist a person in scrubbing and washing difficult to reach areas of the body. For example, brush-like devices are well known to assist in the scrubbing and washing of a user's back. In particular, as most persons prefer showering (versus bathing in a tub) it is often difficult for individuals to wash their feet while standing. This is especially true with the elderly or physically challenged.

There are devices known in the art that provide wall and floor mounted brush-like devices. For example, U.S. Pat. No. 5,228,165 to Westberry et al., and U.S. Pat. No. D374,505 to Garrison, provide such devices. The Westberry invention provides a wall mounted brush that is intended to assist in scratching and/or scrubbing the back of a user. This device could also be adapted for use in cleaning the bottom of a person's foot by placing the device on the floor of, for example, a shower chamber. The Garrison invention specifically provides a foot cleaning brush arrangement. It is important to note, however, that these devices, and others known in the art, still require an individual to apply a cleaning agent (e.g., soap) to the location to be cleaned. Further, these devices do not readily support the convenient cleaning of the top and sides of a foot of a user.

Another type of cleaning device known in the art that does provide a means to apply a cleaning agent to a foot for cleaning purposed is taught by U.S. Pat. No. 4,918,779 to Burns. The Burns invention, which is somewhat structurally complicated, provides a foot activated pedal and a spraying arrangement to spray the cleaning fluid on a foot of a user through two opposing and spaced 'spray bars', and a suitable arrangement of pipes and valves. The spray bars include a series of small, spaced, linearly oriented openings through which cleaning fluid is dispensed. Therefore, the inherent mechanical complexity of the Burns invention seems to yield a device that is relatively expensive and complex to manufacture, and further, may be prone to clogging.

Accordingly, the currently available cleaning devices, including many known foot cleaning arrangements, are lacking in one aspect or another. While these devices and arrangements may be suitable for the particular purposes intended, or for more general use, they would not be suitable for the purposes contemplated for the present invention, as will be fully discussed below.

Objects of the present invention are, therefore, to provide a new and improved foot cleaning device having one or more of the following capabilities, features, characteristics, and/or advantages:

simple and economical construction;

includes a reservoir having an interior cavity for holding a volume of cleaning fluid;

simple arrangement to enable cleaning fluid to be applied to a foot of a user when the user presses down on a main portion of the foot cleaning device of the present invention;

includes a plurality bristles that are arranged to scrub and clean the bottom and sides of a foot of a user;

includes a plurality of scrubbing arcs, preferably having bristles suitably located thereupon, to enable the scrubbing and cleaning of the upper portions and the top of a foot of a user;

having a number of soft pliable structures, including a reservoir and possibly scrubbing arcs; and includes a means, such as suction cups, to secure the foot cleaning device in a selected location, such as the floor of a shower chamber.

The above listed objects, advantages, and associated novel features of the present invention, as well as others, will become more clear from the description and figures provided herein. Attention is called to the fact, however, that the drawings and the associated description are illustrative only. Variations are contemplated as being part of the invention, limited only by the scope of the appended claims.

SUMMARY OF THE INVENTION

In accordance with the present invention, a foot cleaning device for use in cleaning a foot of a user, while the user remains in a substantially standing position. The foot cleaning device, which is intended to be situated at a low level or location in a bathing area, includes a reservoir having a flexible interior cavity that is formed with pliable wall portions. The reservoir is arranged for holding and dispensing a cleaning fluid (when stepped upon). A plurality of bristles are affixed to one or more wall portions, including a top wall portion, of the reservoir. The bristles are arranged to extend in a substantially radial fashion from the wall portions to form a 'brush like surface' that may be employed by a user for foot cleaning activities.

The foot cleaning device would preferably be situated at a low level position or location to enable the easy and convenient use, without having to significantly bend over, or alternately, lift a foot significantly about the bathing or showing chamber floor (i.e., the bottom surface of a bathing or showering chamber). Typically, means would be employed to secure the foot cleaning device in a desired position so as to be employable for foot cleaning activities while being firmly held in place. For example, well known suction cups or hook and eye tape may be employed as such a (fixing or securing) means.

Another structure contemplated to be included with the foot cleaning device of the present invention is a plurality of inwardly curved scrubbing arcs, which are fixed to the reservoir and typically opposingly arranged in pairs to nearly (or actually) form an arch. The arch is so dimensioned that a user may slip (or insert) a foot into the 'arch' and cause the contacting of side and top portions of the foot with the scrubbing arcs during foot cleaning activities. Such 'activities' would typically involve the user stepping upon the foot cleaning device to dispense the cleaning fluid therefrom, moving a foot forward and backward, and possibly side to side, upon the top surface or wall portion of the reservoir, possibly within the scrubbing arcs (thereby causing the contacting of a foot of the user with these surfaces in a scrubbing manner). Other user provided motions and movements may be employed by the user upon the foot cleaning device to produce foot cleaning results.

BRIEF DESCRIPTION OF THE DRAWINGS

In the drawings, like elements are assigned like reference numerals. The drawings are not necessarily to scale, with the emphasis instead placed upon the principles of the present invention. Additionally, each of the embodiments depicted are but one of many possible arrangements utilizing the fundamental concepts of the present invention. As such, the embodiments provided should be considered illustrative only. The drawings are briefly described as follows.

LIST OF REFERENCE NUMERALS USED IN THE DRAWINGS

10 - foot cleaning device

12 - a foot of a user

16 - reservoir

16*a* - top wall portion (of reservoir)

16*b* - side wall portion (of reservoir)

16*c* - bottom wall portion (of reservoir)

18*a* - bristle or bristle bunch

20- interior cavity of reservoir

22- scrubbing arc

22*a* - duct arrangement

26- suction cups (securing means)

30- fill port

30*a* - fill port cap

32- (fluid dispensing) openings

DETAILED DESCRIPTION OF THE PREFERRED EMBODIMENTS

It is important to establish the definition of several important terms that will be used throughout this disclosure. The term 'cleaning fluid' is intended to include any suitable fluid, for example, liquid soap, that may be loaded into the foot cleaning device and subsequently applied when required to a foot of a user for cleaning purposes. The term 'foot cleaning activities' is intended to be broadly defined as motions that will effect, either individually or in combination, the cleaning and scrubbing of a foot of a user. For example, for the embodiment of the invention illustrated in FIG. 1, foot cleaning activities may include stepping upon the foot cleaning device (to dispense the cleaning fluid), a user moving a foot forward and backward, and possibly side to side, upon one or more portions (surfaces) of the foot cleaning device. The expression 'somewhat firmly stepping upon (the reservoir)', or any equivalents such as 'pressing down' or 'stepping upon' the reservoir, are intended to imply that the pressure applied to the reservoir by scrubbing activities will not result in additional amounts of cleaning fluid being applied to a user's foot. As such, in a preferred embodiment of the present invention, basic back and forth scrubbing motions are not intended to cause the dispensing of cleaning fluid. Yet other terms and expressions will be introduced and or defined as needed.

Figure 1:
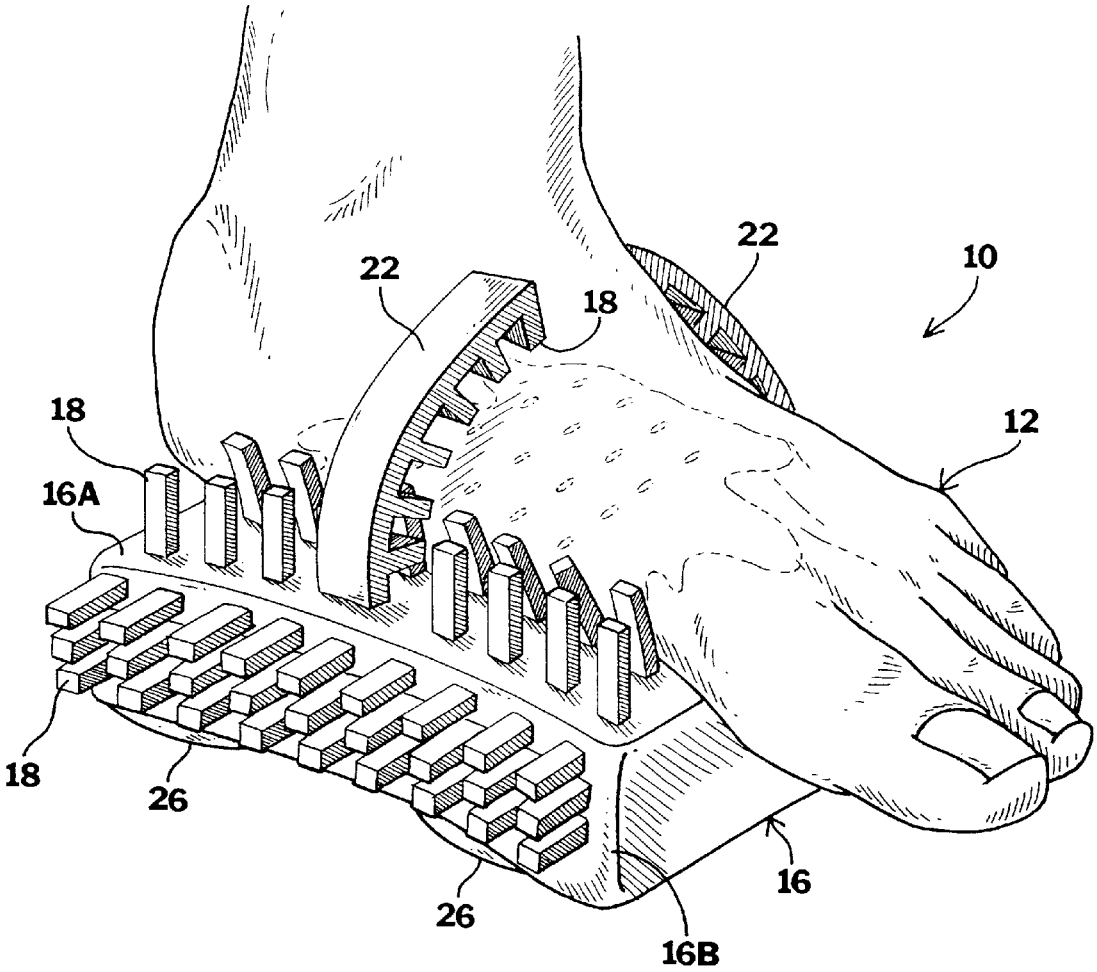
FIG. 1 provides an elevated perspective view of an embodiment of the foot cleaning device according to the present invention.

As can be seen in FIG. 1, the foot cleaning device 10 of the present invention includes a reservoir 16 that in a preferred embodiment is formed with pliable wall portions having a top wall portion 16*a,* a bottom wall portion 16*c,* and side wall portions 16*b.* The reservoir 16 is constructed to dispense a cleaning fluid from an interior chamber 20 via an appropriate arrangement (or means) to apply the cleaning fluid to a user's foot 12 when stepped upon (somewhat firmly) by the user. This operational feature will be fully discussed below. The reservoir 16 is contemplated to be fillable by a user via a fill port 30, which is tightly sealed by a fill port cap 30*a* (except when not being filled). In a preferred embodiment of the invention the fill port cap 30*a* may mate with threading (not shown) provided on the fill port 30 to form the required tight seal.

As illustrated in FIGS. 1 through 4, a plurality of bristles 18 may be provided with the foot cleaning device 10. In a preferred embodiment of the invention, the bristles 18 are arranged to extend, in a substantially radial fashion, from the top wall portion 16*a* and at least one side wall portion 16*b* of the reservoir 16. It should be noted that each bristle 18 may be formed by a single monolithic material, such as foam, or alternately, by a plurality of thin and elongated fibers (or individual 'bristles'). The bristles 18 associated with the top wall portion 16*a* will be used to scrub and clean bottom portions of a foot 12 of a user. Similarly, the bristles 18 associated with the side wall portion(s) 16*b* of the reservoir 16 will enable a user to clean the front, side, and/or back portions of a foot 12. As also illustrated in FIG. 1, scrubbing arcs 22 may be employed to enable a user to scrub and clean the upper portions of a foot. In a preferred embodiment of the present invention, the scrubbing arcs 22 may be each have an inner surface with a plurality of bristles 18 provided to scrub and clean the upper or top portions of a foot 12 of a user. The scrubbing arcs 22 would typically be configured to be inwardly curved and suitably fixed to the reservoir, and opposingly arranged in pairs to nearly form an arch. Accordingly, a user may insert or simply slip a foot 12 into the scrubbing arcs 22, to contact top and side portions of the user's foot, possibly via suitably arranged bristles 18.

Figure 2:
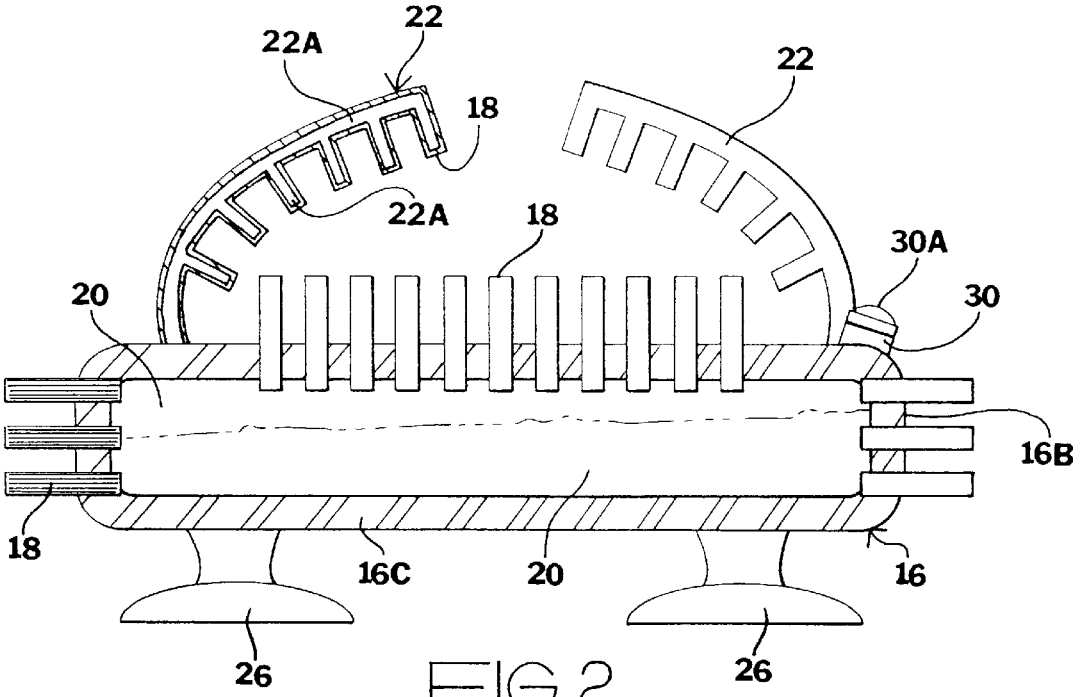
FIG. 2 depicts a cross-sectional front view of the embodiment of FIG. 1.
Figure 4:
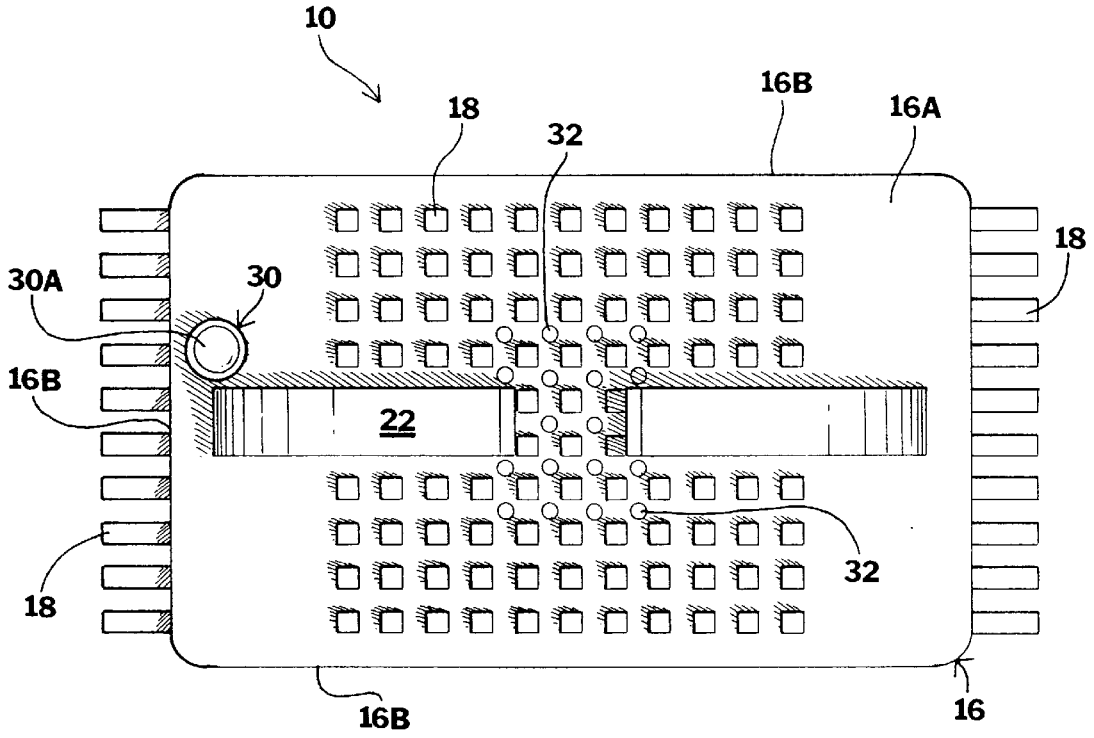
FIG. 4 is a top view of a preferred embodiment of the invention.

An important feature of the present invention is provided by the convenient dispensing and application of cleaning fluid (e.g., liquid soap) to a user's foot, via a simple and functional means, when desired by the user. As seen in FIG. 1, and better seen in FIG. 4, cleaning fluid may be dispensed and applied from the interior cavity 20 (of the reservoir 16) to the bottom of a foot 12 of a user by one or more small openings 32 or slits (with the slits are not explicitly shown). A perforated region, as shown in FIG. 4, may be formed by a plurality of openings 32 being somewhat closely grouped around the bristles 18. Alternately, or possibly in addition to the use of openings 32, or equivalents, cleaning fluid may be applied to a foot 12 via a 'duct arrangement' 22*a* incorporated within at least one scrubbing arc 22 (as clearly shown in FIG. 2). It should be noted that other arrangements are contemplated for delivering and applying cleaning fluid to a foot 12 of a user as well. For example, as shown in FIG. 2, the bristles 18, say of the top wall portion 16*a,* may enable cleaning fluid to pass from the interior of the reservoir 16 through the bristles 18 and be directly applied to a foot 12 of a user (by contacting the bristles 18). Yet other dispensing arrangements may be provided, in accordance with present invention, by skilled persons.

Figure 3:
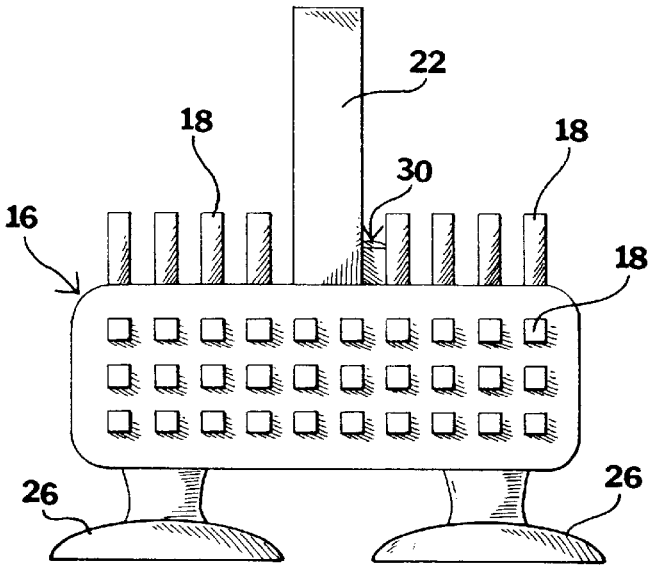
FIG. 3 illustrates a possible side view of an embodiment of the invention.

As best shown in FIGS. 2 and 3, one or more suction cups 26 may be included to secure the foot cleaning device 10 in a desired position so as to be easily and conveniently employed for foot cleaning activities by a user. These foot cleaning activities initiated by the user will essentially involve one or more of stepping upon (possibly somewhat firmly) the top wall portion 16*a* of the foot cleaning device 10 to dispense and apply the cleaning fluid to a foot 12, moving a foot 12 forward and backward (and possibly from side to side) upon the top wall portion 16*a* of the reservoir

16 thereby causing the contacting of a bottom portion of the foot 12 in a scrubbing manner with suitably positioned bristles 18, and moving a foot 12 forward and backward (possibly from side to side) upon a bristle equipped side wall portion 16*b* of the reservoir 16 thereby causing the contacting of at least one of a side, front, and back portion of a foot 12 for scrubbing and cleaning purposes. Further, if the scrubbing arcs 22 are included a user may insert or slip a foot 12 into the arcs (i.e., into the arch formed by opposingly paired scrubbing arcs 22) to contact side and top portions of a foot 12 while employing cleaning motions, such as forward and back movements, to clean the top and upper portions of a foot 12. The desired position, at a low level location, would include being situated on the floor of the bathing or showering chamber, or the like.

It is important to understand that the above descriptions of the foot scrubbing and foot cleaning device 10 of the present invention are exemplary only, and other equivalent arrangements may be provided by skilled artisans. Therefore, while there have been described the currently preferred embodiments of the present invention, those skilled in the art will recognize that other and further modifications may be made without departing from the present invention, and it is intended to claim all modifications and variations as fall within the scope of the invention.

What is claimed is:

1. A foot cleaning device for use in cleaning a foot of a user, the foot cleaning device intended to be situated at a low level location in a bathing area, and comprising:

a) a reservoir having a flexible interior cavity, which is formed with pliable wall portions, arranged for holding and dispensing a cleaning fluid when stepped upon by the user, the reservoir wall portions including a top wall portion and side wall portions;

b) a plurality of bristles affixed to the top wall portion and on at least one of the side wall portions of the reservoir, and arranged to extend in a substantially radial fashion therefrom;

c) a plurality of inwardly curved scrubbing arcs having an inner surface with a plurality of bristles fixed thereto to assist in the scrubbing and cleaning of the foot, said arcs being attached to the reservoir and opposingly arranged in pairs to nearly form an arch into which the user may insert a foot to contact side and top portions during cleaning activities;

d) means to dispense cleaning fluid including at least one of the following: a plurality of slits located upon the top wall portion; a plurality of openings located upon the top wall portion that are situated around and between a plurality of the bristles; and the bristles, configured to enable the cleaning fluid to pass though at least one of the plurality of the bristles located upon at least one of the top wall portion of the reservoir and a scrubbing arc; and e) means to secure the foot cleaning device in a desired position so as to be easily and conveniently employed for foot cleaning activities, said means including at least one suction cup based device that will enable the foot cleaning device to be placed and held in a user selected location.

* * * * *